US007397194B2

(12) United States Patent
Garbowicz et al.

(10) Patent No.: US 7,397,194 B2
(45) Date of Patent: Jul. 8, 2008

(54) AUXILIARY QUARTZ LAMP LIGHTING SYSTEM FOR HIGH INTENSITY DISCHARGE LAMP BALLASTS

(75) Inventors: Glenn Garbowicz, Algonquin, IL (US); Thomas Mayer, Wisconsin Dells, WI (US)

(73) Assignee: Varon Lighting, Inc., Elmhurst, IL (US)

( * ) Notice: Subject to any disclaimer, the term of this patent is extended or adjusted under 35 U.S.C. 154(b) by 75 days.

(21) Appl. No.: 11/469,484

(22) Filed: Sep. 1, 2006

(65) Prior Publication Data

US 2007/0205729 A1 Sep. 6, 2007

Related U.S. Application Data

(63) Continuation-in-part of application No. 11/178,785, filed on Jul. 11, 2005, now Pat. No. 7,282,863.

(51) Int. Cl.
*H05B 37/00* (2006.01)
*H05B 37/02* (2006.01)

(52) U.S. Cl. ..... 315/86; 315/88; 315/360

(58) Field of Classification Search ..... 315/86, 315/88, 137, 141, 144, 209 R, 291, 360, 362
See application file for complete search history.

(56) References Cited

U.S. PATENT DOCUMENTS 3,976,910 A * 8/1976 Owens et al. ..... 315/92
4,996,463 A * 2/1991 Horowitz ..... 315/250
5,300,863 A * 4/1994 Mayer ..... 315/276
5,430,354 A * 7/1995 Garbowicz et al. ..... 315/88
6,072,286 A * 6/2000 Sears ..... 315/313
6,489,729 B1 * 12/2002 Erhardt et al. ..... 315/209 R
6,703,795 B2 * 3/2004 Johnson ..... 315/273
7,139,680 B2 * 11/2006 Orozco ..... 702/188

* cited by examiner

*Primary Examiner*—Thuy Vinh Tran
(74) *Attorney, Agent, or Firm*—Levenfeld Pearlstein; Mitchell J. Weinstein; Marc E. Fineman

(57) ABSTRACT

The invention comprises an auxiliary lamp controller and related circuits to operate an auxiliary lamp and circuit to light auxiliary lamps at 120 VAC and 50-60 Hz current connected to an electronic HID ballast operating at a frequency of 50-60 Hz to over 400 kHz and voltages of 120-277 VAC or connected to a magnetic HID ballast operating at 120-277 VAC and 50-60 Hz, as provided by a multitap transformer and related circuitry wherein the auxiliary lamp is illuminated during HID lamp phases of being extinguished from loss of power or other reasons, and during cool-down, start-up and warm-up phases of the HID lamp, and the auxiliary lamp is extinguished upon the HID lamp reaching full illumination phase.

24 Claims, 3 Drawing Sheets

AUXILIARY QUARTZ LAMP LIGHTING SYSTEM FOR HIGH INTENSITY DISCHARGE LAMP BALLASTS

This application is a continuation-in-part of application Ser. No. 11/178,785, filed on Jul. 11, 2005, which is now U.S. Pat. No. 7,282,863.

FIELD OF THE INVENTION

This invention relates to a control system for an auxiliary lamp lighting system for a high intensity discharge (HID) lamp ballast. More particularly, this invention concerns an operating circuit for an auxiliary lamp wherein the auxiliary lamp is ignited when power to the HID lamp is interrupted and the HID tamp is extinguished. Power interruptions of even a very short duration will often cause the HID lamp to be extinguished. After restoration of power, the HID lamp will ignite only after gasses within the HID lamp have sufficiently cooled to allow re-ignition. Auxiliary lighting sources are typically used to provide illumination during the period following power interruption and during the time required to re-ignite to full illumination.

The improved control system for an auxiliary lamp lighting system controls the auxiliary tamp lighting system to provide illumination during the extinguished, cool-down, start-up and warm-up phases of the HID lamp with an electronic ballast and with a magnetic ballast.

The instant invented control system for an auxiliary lighting circuit allows the controller to be used with virtually any type lamp or lamp operating circuit. The invented control system and related circuits permit its use with a wide wattage range of from 35 to 400 watts of quartz lamps and incandescent lamps, quartz vapor lamps, high intensity discharge lamps, gaseous discharge lamps, fluorescent lamps light emitting diode (LED) lamps and other type lamps. The invented controller and related circuits utilize an off-delay timing circuit allowing for sufficient gaseous discharge lamp warm-up and circuitry that permits use of resistive or inductive auxiliary lighting loads.

High intensity discharge (HID) lamps with electronic ballasts are increasingly accepted for commercial and industrial applications illuminating large open spaces such as construction sites, stadiums, parking lots, warehouses, and roadways. As such, an alternative source of exterior illumination source provided by a quartz lamp and its related controller is highly desirable.

HID lamps can operate at a moderate voltage; a ballast typically limits the current to light the lamp since the voltage appears across the lamp electrodes causing the vapor to break down into a self-maintaining discharge. The ballast limits the current to a safe value since the discharge is not inherently self-limiting. The instant invented controller for an auxiliary lamp lighting system accordingly operates in accordance with the HID lamp ballast to control the current to the HID lamp. The invented controller for the auxiliary lamp lighting system accordingly controls the auxiliary lamp circuits to initiate illumination when the HID lamp is extinguished and to "switch off" the auxiliary lamp when the HID lamp again is at full illumination.

The necessity to control the operation of the auxiliary lamp in conjunction with the operation of an HID lamp has become a problem when HID lamp circuits use electronic HID ballast circuits. HID lamp circuits have been switching gradually from traditional magnetic ballast circuits to electronic HID ballast circuits. Auxiliary quartz gaseous discharge lamp circuits also have been switching gradually from mid-wattage lamps (50×50 watts) to low wattage lamps (35-50 watts), which require current sensitive transformers and improved auxiliary lamp turnout capability with the lower wattage used. Current sensitive transformers are defined as transformers that respond to and provide amperes of current per ampere of wattage required to cause a gaseous discharge lamp of designated wattage to illuminate. A required current sensitive transformer is obtained by a required turns ratio of the secondary winding relative to the primary winding of the transformer.

Semiconductors are used to control output lamp current in electronic HID ballasts. The control elements in the electronic ballasts operate at a higher frequency than conventional magnetic ballasts. Electronic ballast systems typically convert alternating current sources having a relatively low frequency in the range of from 50-60 Hz to a higher frequency typically in the range of 100 Hz-400 kHz. The conversion typically involves a two-stage process, wherein AC oscillation having a frequency of 50 to 60 Hz is first rectified to a DC voltage and then this DC voltage is chopped at a higher frequency to produce alternating current in the frequency range of 100 Hz-400 kHz.

BACKGROUND OF THE INVENTION

High intensity discharge lamps require a certain warm-up period, approximately five minutes, before the light output of the high intensity lamp reaches usable levels. Also, if a supply voltage drop is experienced, the high intensity lamp will extinguish and will not again reach a usable light output until after a substantial cool-down period and subsequent restart period; an accumulative period of approximately 15 minutes. In certain applications for these lamps wherein these lamps are the primary source of illumination, the period prior to attaining full luminescence after the period subsequent to a supply voltage drop in which the lamp is extinguished can result in substantial inconveniences. In certain specific applications such as hospitals, supermarkets, and department stores, sudden light failure of a primary light source resulting from a voltage drop can cause patients or patrons to expose themselves or others to injury.

Accordingly, control devices for auxiliary lamps have been sought to automatically provide auxiliary lighting when the high intensity discharge lamp is in a low luminescence condition. However, control devices have not been readily available for an auxiliary light source for use with electronic high intensity discharge lamp ballasts to provide supplemental lighting during extinguished, cool-down, start-up and warm-up phases of operation of an associated high intensity discharge tamp.

The provision of an auxiliary control circuit for an auxiliary tamp which automatically functions to provide lighting during times when the high intensity discharge lamp is not at full luminescence can encounter an operational frequency mismatch of the 50/60 Hz frequency operation of conventional power supplies and the 100 Hz-400 kHz frequency of operation of electronic high intensity discharge tamp ballasts. Additionally, conventional auxiliary tamps may use a power source of 120 VAC whereas high intensity discharge tamp electronic ballasts operate over a range of voltages of 120-277 VAC.

Electronic HID ballast systems for HID tamps have been provided as alternatives to traditional magnetic ballasts in both low wattage applications and mid-wattage applications of 50 to 450 watts, although low wattage HID lamps frequently have not used auxiliary emergency lighting sources. Auxiliary gaseous discharge lamp lighting systems now are used for low wattage gaseous discharge lamps (35-50 watts) and mid-wattage (50-450 watts) gaseous discharge lamps with electronic ballasts. The instant invented control system for an auxiliary lighting circuit for a gaseous discharge lamp and other type lamps may be used as a lighting controller for low wattage, mid-wattage and higher wattage applications, and may be used with either electronic or magnetic type ballasts for high intensity discharge lamps, basis the reset and timing circuits included therein.

DESCRIPTION OF THE PRIOR ART

In the prior art, U.S. Pat. No. 3,927,348 to Zawadski teaches and claims a control system for an auxiliary lamp to provide supplementary lighting for a high intensity discharge lamp. The auxiliary lamp control circuit utilizes a single reed switch to control the auxiliary lamp. The flux of a permanent magnet determines operation of the reed switch to deliver a gating signal to a triac transistor to cause the auxiliary lamp to light.

U.S. Pat. No. 3,976,910 Owens et al. teaches and claims a starting and operating circuit for gaseous discharge lamps and an auxiliary incandescent lamp. The circuit comprises an induction coil, a charging capacitor and control switch. The control switch is a triac transistor having a gate electrode, which, when gated, causes the switch to conduct and cause a diac transistor to conduct upon application of a breakdown voltage. The actuating circuit is connected to the junction of the induction coil means and the discharge lamp means.

U.S. Pat. No. 4,005,331 to Horowitz teaches and claims an emergency lighting system of a mercury vapor lamp and an incandescent lamp wherein voltage sensitive relays operate when the voltage across the mercury vapor lamp achieves a predetermined value. Normally closed contacts of a relay across the mercury vapor lamp are in series with the incandescent lamp.

U.S. Pat. No. 4,996,463 to Horowitz teaches and claims an auxiliary lighting system to be used with a high intensity discharge lamp having a solid-state electronic ballast and an auxiliary lamp which is connected to a source of power through normally closed contacts of a relay coil in the input line to the solid-state ballast. Above a predetermined threshold current level to the ballast, the relay coil causes the normally closed contacts to open to extinguish the auxiliary lamp. Below a threshold current level to the ballast, the closed contacts cause the auxiliary lamp to turn on.

U.S. Pat. No. 5,300,863 to Mayer teaches and claims an auxiliary lighting circuit for a gaseous discharge lamp and an auxiliary lighting source comprising a current transformer comprising primary and secondary coils. The primary coil of the current transformer of the auxiliary lighting circuit is in series between the gaseous discharge lamp and main power source to produce a voltage in the secondary coil of said transformer as an auxiliary power source. A first gated triac transistor is in series between the auxiliary power source and the auxiliary light source. A second gated triac transistor is coupled between the first gated triac and said current transformer such that the first gated triac is non-conductive only when current is drawn by the gaseous discharge lamp. When no current is drawn by the gaseous discharge lamp, the first gated triac is conductive, and power is applied to the auxiliary fighting source to turn the auxiliary lamp on.

U.S. Pat. No. 5,430,354 to Garbowicz teaches and claims a ballast for lighting a first lamp and a second lamp. It comprises a current control means responsive to flow of current there-through for controlling current through the first lamp, a switching control means responsive to a switching signal including a triac transistor having a gate and an opto-coupler connected to said gate for supplying a switching signal to said switching means.

U.S. Pat. No. 6,703,795 B2 to Johnson teaches and claims an auxiliary lighting system to illuminate an auxiliary lamp to supplement a high intensity discharge (HID) lamp from the time the HID lamp is activated until the HID lamp achieves full illumination. The lighting system includes a primary lamp circuit, an auxiliary lamp circuit and an auxiliary controller. The auxiliary controller is connected between the primary lamp circuit and the auxiliary lamp circuit to sense a voltage of the primary lamp circuit. When the said voltage exceeds a threshold voltage, the auxiliary lamp is extinguished. The auxiliary controller includes a power supply circuit, a switching circuit and a coupling circuit. The power supply circuit has input and output voltage. The switching circuit has open and closed states. The coupling circuit may have an optically isolated triac transistor that has open and closed states. The triac transistor may be triggered into conduction when a breakover voltage on a diac transistor is exceeded.

Accordingly, in the prior art it is well known to provide a control system for an auxiliary lamp, which provides supplementary lighting for a high intensity discharge (HID) lamp. In general, it is well known to use a triac transistor having a gate as a switch device to determine the operation of an auxiliary lamp, as well as a reed switch and voltage sensitive relays. It is also well known to use voltage levels and/or current levels as determinate means to activate the switch devices.

In general, it is therefore well-known to provide a source of the switching signal by a sensing circuit across the terminals of the HID lamp (U.S. Pat. No. 3,927,348), an induction coil connected to the input side of an alternative current source (U.S. Pat. No. 3,976,910); the current level through the high intensity discharge lamp (U.S. Pat. No. 4,005,331); the current flow drawn by a high intensity discharge lamp (U.S. Pat. No. 5,300,863); a switching signal provided by an opto-coupler in response to current drawn by the high intensity discharge lamp (U.S. Pat. No. 5,430,354); and a switching signal provided by a voltage change when the high intensity discharge lamp voltage exceeds a certain threshold (U.S. Pat. No. 6,703,795).

While the above circuits provide control means for an auxiliary lamp in conjunction with an HID lamp and means of providing a control signal to activate the control means have reference to current and voltage levels, differences exist in the switching means providing the voltage or current level required. Control circuits designed for 50/60 Hz operations typically do not function at the output frequency of electronic ballasts, typically 100 Hz-400 kHz, used in the mid-wattage gaseous discharge lamps (50-450 watts) or in low-wattage gaseous discharge lamps (35-50 watts) with resistive or inductive auxiliary lighting loads.

Gaseous discharge lamps are defined as lamps emitting light in an electric discharge in the gas of the lamps, which lamps differ from incandescent lamps. Gaseous discharge lamps need to be provided with a starter circuit and ballast to shift from an off-state to an on-state. In the instant invented control system, the ballast for a gaseous discharge lamp includes a starter circuit. The instant invented control system is accordingly particularly suited for operation in conjunction with auxiliary lamps comprising gaseous discharge lamps.

The instant invented controller and auxiliary lighting circuit for a gaseous discharge lamp comprises a non-arcing electrical switch wherein a solid-state switching element is operated in response to current flow within an external circuit. The switch is particularly suitable for use within an auxiliary lighting circuit for a gaseous discharge lamp. Because the switch operates in response to current drawn by the gaseous discharge lamp rather than a specific sensed voltage, it can be suitable for virtually any type of lamp or lamp operating circuit. The invented controller and related circuit sensitivity to low power levels drawn by the gaseous discharge lamp, as low as 35 watts, allows the controller and circuit use on low wattage gaseous discharge lamps. The controller and related circuit include a current sensing transformer circuit, a positive power supply circuit to convert an AC voltage from the current sensing transformer to a regulated positive DC power supply, a negative power supply circuit to convert the regulated positive DC power supply into a negative DC regulated power supply, a reset circuit to reset the accompanying timing circuit in the event the gaseous discharge lamp is extinguished by power interruption or end-of life cycling, a timing circuit to maintain the "on" state of an auxiliary lighting source for a pre-determined period of time to allow the high intensity discharge (HID) lamp to achieve full intensity before extinguishing the auxiliary light source and an auxiliary lamp control circuit, which determines the status of the auxiliary light source.

The current invented controller and related circuit accordingly provide a circuit and method for timely operating an auxiliary lamp comprising a gaseous discharge lamp at 120 VAC 50/60 Hz as an auxiliary lighting lamp, and also, alternatively, a quartz lamp, an incandescent lamp, a quartz vapor lamp, a high intensity discharge lamp, a fluorescent lamp and an LED lamp for use with high intensity discharge (HID) lamps using electronic HID ballasts and magnetic HID ballasts for gaseous discharge lamps in the low-wattage range of 35-50 watts and mid-wattage range of 150-450 watts wherein the HID electric ballast output is an output frequency of typically 100 Hz-400 kHz and higher.

While the above discussed prior art references disclose methods of activating and controlling lighting of auxiliary lamps in conjunction with HID lamp installations, none are known to the inventor which reveal a controller and specific workable circuits for achieving and supplying proper voltage and current levels for a gaseous discharge auxiliary lamp and, alternatively, other type lamps in conjunction with lighting operation of a HID lamp and an electronic HID ballast or a magnetic HID ballast with low wattage or mid-wattage gaseous discharge lamps.

SUMMARY OF THE INVENTION

The invention comprises a control system and related circuits for different auxiliary lighting loads including auxiliary gaseous discharge lamps and other type lamps to provide supplementary lighting during extinguished, cool-down, start-up and warm-up phases of operation of associated electronic HID and magnetic ballast HID lamps wherein the auxiliary illumination is at full illumination until the HID lamp is at full illumination. The invention comprises an invented controller and circuits suitable for a high intensity discharge lamp electronic ballast or a high intensity discharge lamp magnetic ballast wherein a solid-state switch is caused to switch on the auxiliary lamp selected from the group of quartz lamps, incandescent lamps, quartz vapor lamps, gaseous discharge lamps, fluorescent lamps and LED lamps.

The invention particularly comprises an invented controller and circuits to operate a gaseous discharge auxiliary lamp and other type lamps, lighting system of 120 VAC, 50-60 cycle current based on operation of an electronic high intensity discharge ballast operating at frequencies of from 100 Hz-400 kHz and AC voltages of 120 volts or a magnetic high intensity discharge ballast using a solid-state switch to switch on the gaseous discharge lamp when the HID lamp is extinguished and to switch off the gaseous discharge lamp and other type lamps when the HID lamp operates to provide full illumination and draws a steady state level of current only after the HID lamp is at full illumination. The solid-state switch comprises gated triacs activated to switch off the auxiliary gaseous discharge lamp and other type lamps in conjunction with the included reset circuit and timing circuit.

If the ballast is an electronic HID ballast and the auxiliary lamp is a gaseous discharge lamp or other type lamp, the invention utilizes the sharp increase in threshold current from the current power source, drawn by an electronic ballast of a high intensity discharge lamp when the HID lamp turns on. The increase in the HID tamp threshold current to the auxiliary gaseous discharge lamp ballast activates the auxiliary gaseous discharge tamp or other type lamp lighting controller circuit to cause the auxiliary lamp to cease to provide auxiliary illumination, as determined by a reset circuit and timing circuit, after the HID lamp reaches full illumination. The auxiliary lighting controller utilizes the solid-state switch comprising two gated triac transistors as switch devices in conjunction with a diac transistor and a coupled transformer.

If the ballast is a magnetic HID ballast and the auxiliary lamp is a gaseous discharge lamp or other type lamp, in the absence of a sharp increase in the HID tamp threshold current drawn by a magnetic ballast because the no-load and fully-loaded input currents of a magnetic ballast are not significantly different, the instant invented circuit operates basis the included reset circuit and timing circuit, to cause the illuminating auxiliary lamp to cease illumination after the HID lamp reaches full illumination.

The invention accordingly comprises a control system in series with a power source for an electronic HID ballast or magnetic HID ballast with a low-wattage and mid-wattage high intensity discharge tamp as an auxiliary lamp, basis an improved sensitivity of the current transformer for a low wattage and mid-wattage gaseous discharge lamp with an increased ratio of the transformer secondary winding to the primary winding. The control system controls a conventional 120 volt 50-60 cycle auxiliary lighting lamp to illuminate upon failure of the HID lamp to provide illumination and to switch power off to the 120 volt 50-60 cycle auxiliary lighting lamp when the HID lamp operates to provide full illumination. Within the scope of the invention, the invention comprises a controller and electrical circuit for providing power to the electronic HID ballast or magnetic HID ballast and to the auxiliary lighting lamp controller comprising a solid-state switch for providing current to the auxiliary lamp to provide illumination when the HID lamp is not providing full illumination and to switch off the auxiliary lighting lamp when the HID lamp is fully operational.

Auxiliary lamps 30A and 30C comprise quartz, incandescent lamps or LED lamps. Auxiliary lamps 3B and 30D comprise gaseous discharge lamps, quartz vapor lamps, or high intensity discharge lamps with associated ballast 25. Auxiliary lamp 30E comprises fluorescent lamp 30E with associated staffer 50 and ballast 25.

Auxiliary lamps 30A, B, C, D, and E as designated in FIGS. 1-6, hereinafter may be designated as auxiliary lamp 30 where appropriate.

DETAILED DESCRIPTION OF THE INVENTION

Figure 1:
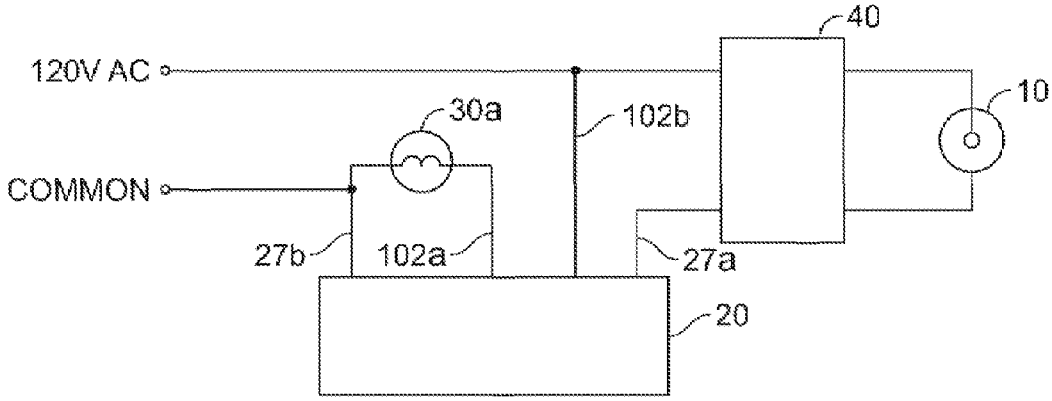
FIG. 1 is a schematic diagram of an electronic HID ballast configuration circuit wherein auxiliary lamp 30A is selected from the group consisting of an incandescent lamp, a quartz incandescent lamp and an LED (light emitting diode) lamp.

FIG. 1 is a schematic diagram of conventional high intensity discharge (HID) lamp 10 connected to a 120 VAC electronic HID ballast 40 and an auxiliary lighting controller 20 in series between the 120 VAC power supply and the 120 VAC electronic HID ballast 40. The 120 VAC electronic HID ballast 40 in this particular embodiment is provided from a plurality of input taps on a multitap transformer, so that different AC voltages from a power source and frequencies of from 100 Hz to more than 400 kHz can be used to operate high intensity gaseous discharge lamp 10. Auxiliary lamp 30A can be selected from the group consisting of an incandescent lamp, a quartz incandescent lamp and an LED (light emitting diode) lamp.

Auxiliary gaseous discharge lamp 30A, which supplements the high intensity discharge (HID) lamp 10 as an illumination source operates as an illumination source by effectively being "on" at all times except when auxiliary lighting lamp 30A is caused to be turned of by the 120 VAC electronic HID ballast drawing a full power current level to operate the HID lamp 10 at full illumination level after the HID lamp cool-down, start-up and warm-up period. Auxiliary lighting controller 20 operates to turn "off" auxiliary quartz lamp 30A when the operational level of current drawn by the fully operational HID lamp 10 reaches a predetermined threshold current level as determined by the operational characteristics of the reset circuit and timing circuit of the auxiliary lamp lighting controller 20.

Figure 2:
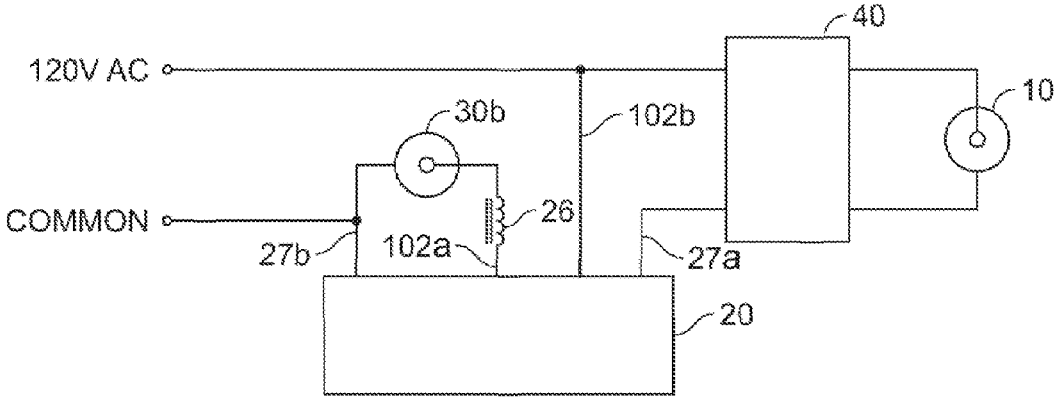
FIG. 2 is a schematic diagram of an electronic HID ballast configuration circuit wherein the auxiliary lamp 30B is selected from the group consisting of a gaseous discharge lamp, a high intensity discharge lamp, a fluorescent lamp and a ballast 25.

FIG. 2 is a schematic diagram of a conventional high intensity discharge lamp 10 connected to a 120 VAC electronic HID ballast 40 and a particular embodiment of the auxiliary lighting controller 20. Terminal 27A is connected in series with the primary side of the 120 VAC electronic HID ballast. Terminal 27B is connected to the common conductor of the 120 VAC current source. Terminals 102A and 27B are connected in series with auxiliary lamp 308 and its associated ballast 25 and to the 120 VAC power input. Auxiliary lamp 308 can be a gaseous discharge lamp, an HID lamp or a fluorescent lamp, each of which require a ballast for operation.

Figure 3:
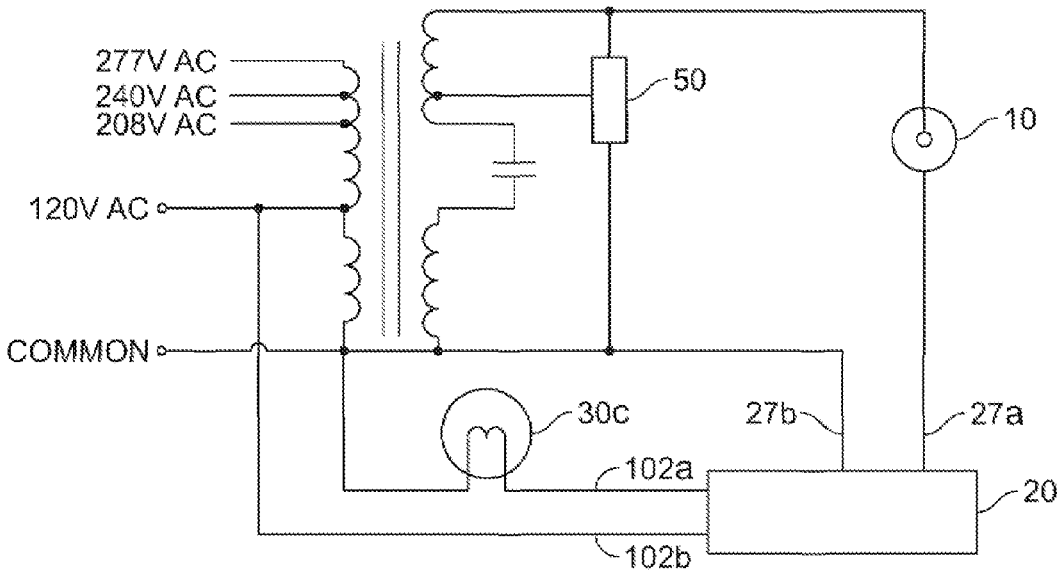
FIG. 3 is a schematic diagram of a magnetic HID ballast configuration circuit wherein the auxiliary lamp 30C is selected from the group consisting of an incandescent lamp, a quartz incandescent lamp and an LED (light emitting diode) lamp.

FIG. 3 is a schematic diagram of a particular embodiment of a conventional high intensity discharge (HID) lamp 10 connected to a 120 VAC input tap on multitap transformer magnetic ballast TR1 and auxiliary lighting controller 20 connected in series with auxiliary lamp 30C and controlled by the timing circuit and reset circuit of lighting controller 20. In this embodiment, auxiliary lamp 30C can be an incandescent lamp, a quartz incandescent lamp or an LED (light emitting diode) lamp.

Figure 4:
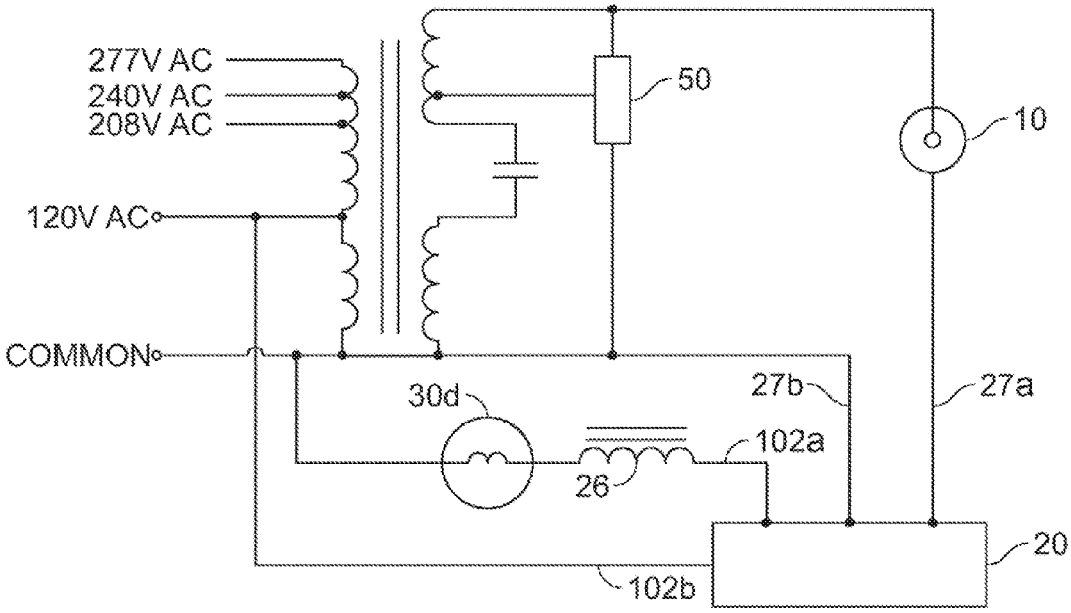
FIG. 4 is a schematic diagram of a magnetic HID ballast configuration circuit wherein the auxiliary lamp 30D is selected from the group consisting of a gaseous discharge lamp, a high intensity discharge lamp, a fluorescent lamp and a ballast 25.

FIG. 4 is a schematic diagram of a particular embodiment of a conventional high intensity discharge (HID) lamp 10 connected to a 120 VAC tap or multitap transformer magnetic ballast TR1 and an auxiliary lighting controller connected in series with auxiliary lamp 30D and associated ballast 25 and controlled by the timing circuit and reset circuit of lighting controller 20. In this embodiment, auxiliary lamp 30D can be a gaseous discharge lamp, an HID lamp or a fluorescent lamp, which require ballasts for operation.

In the alternative embodiment of multitap transformer TR1 (FIG. 3 and FIG. 4), the timing circuit activated by the reset circuit causes lamp lighting controller 20 to cause auxiliary lamp 30 to cease illumination upon full illumination of HID lamp 10.

Figure 5:
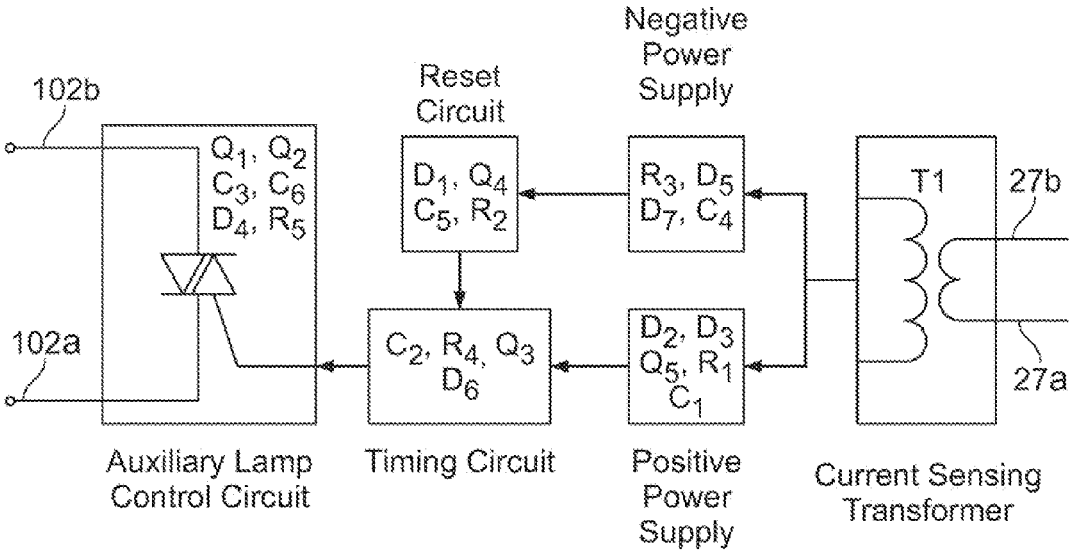
FIG. 5 is a block diagram of the auxiliary lamp controller in accordance with the present invention.

FIG. 5 is a block diagram of the auxiliary lighting controller illustrating the separate circuits of controller 20 which comprise a positive power supply circuit, a negative power supply circuit, a reset circuit, a timing circuit and an auxiliary lamp control circuit.

Figure 6:
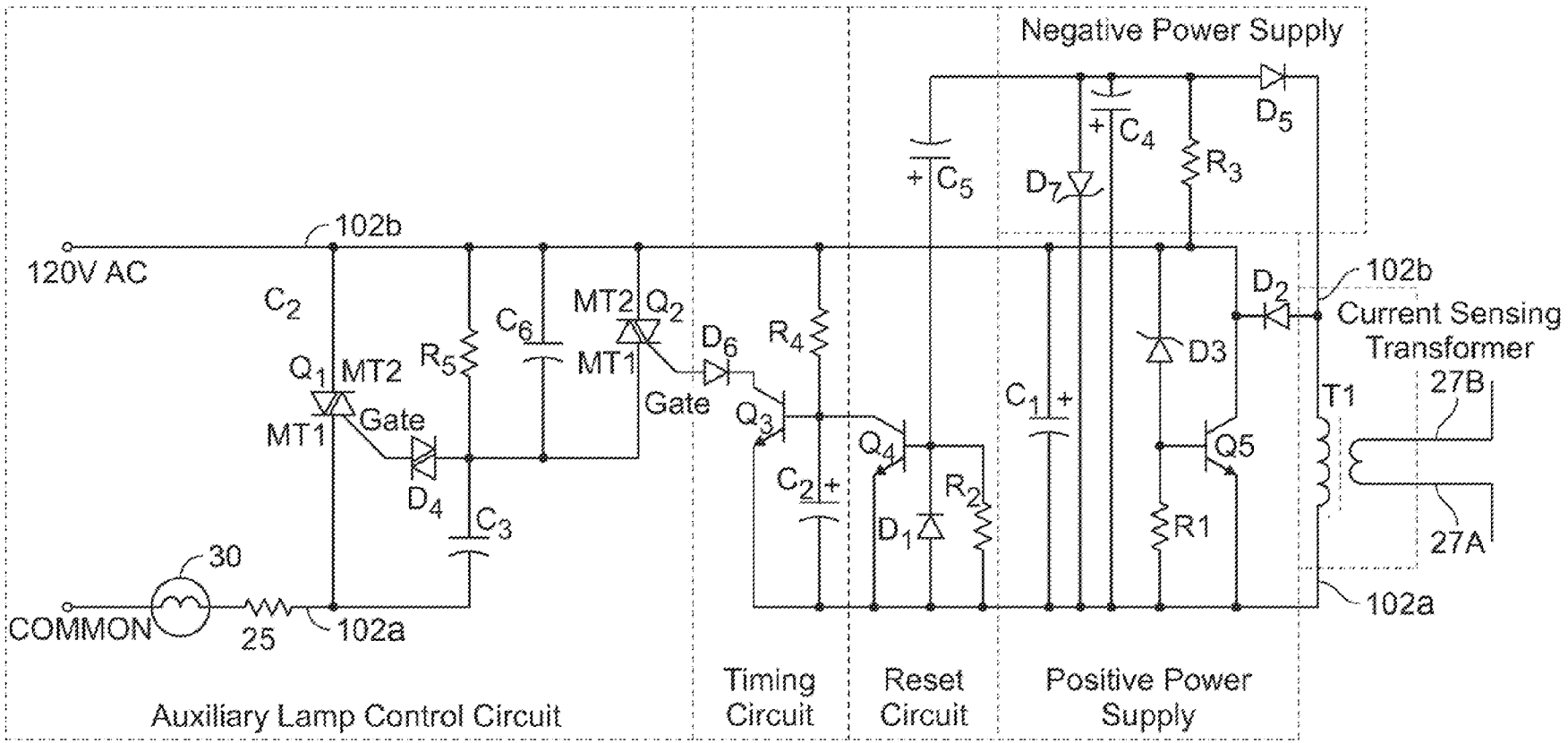
FIG. 6 is a schematic of an auxiliary lamp lighting controller circuit in accordance with the present invention.

In an embodiment of the instant invention comprising an auxiliary gaseous discharge lamp, as illustrated in FIG. 6 of the schematic of the auxiliary controller, lighting controller 20 comprises an auxiliary lamp control circuit of an electronic switch comprising triac Q1 and triac Q2 across the secondary winding of the controller current transformer TI, which supplies current through the TI secondary winding to auxiliary gaseous discharge lamp 30 and to ballast 25 (FIG. 2 and FIG. 4) through terminals 102A and 102B to activate auxiliary gaseous discharge lamp 30. The primary winding of said current transformer TI for supplying current to lamp 30 and ballast 25 (FIG. 2 and FIG. 4) is connected in series with the common input current tap of the primary winding of the multitap transformer of the 120 VAC electronic HID ballast, so that when the electronic HID ballast draws full threshold current to operate the HID lamp at full illumination, the sharp increase caused by full illumination in threshold current, hereinafter termed a "step function," causes lamp lighting controller 20 to cause gaseous discharge auxiliary lamp 30 to cease illumination as determined by operational characteristics of the reset circuit and timing circuit of controller 20 upon full illumination of the HID lamp 10.

As shown in FIGS. 1-6, the circuitry of controller 20 comprises two terminals, 27A and 27B, which are in series with the common input voltage tap. When the electronic or magnetic ballast is drawing full current to operate the HID lamp 10 at full illumination, the circuitry of controller 20 acts to cause an open circuit across the terminals 102A and 102B to prevent auxiliary lamp 30 from operating. The 102A terminal is connected in series to ballast 25 (FIG. 2 and FIG. 4) and lamp 30. The 102B terminal is connected in series to the 120 VAC power input.

Controller 20 detects the current drawn by the ballast 40 (FIG. 1 and FIG. 2), which current flows through the primary winding of transformer TI by terminals 27A and 27B. When lamp 10 is operating at full illumination and hence drawing full current, the electronic switch of controller 20 acts to open circuit between terminals 102A and 1026, thus preventing auxiliary lamp 30 from operating. When lamp 10 ceases to operate, as indicated by a lower current drawn by ballast 40 (either electronic or magnetic) between terminals 27A and 27B, the solid-state switch of controller 20 provides a conductive path between terminals 102A and 1028, thus causing auxiliary lamp 30 to illuminate.

Although the operation of the auxiliary lighting circuit has been described with reference to a specific ballast lamp circuit, it should be appreciated that one of the primary advantages of the present invention is that it can be used in conjunction with an electronic or magnetic ballast in virtually any circuit and permits the use of resistive or inductive auxiliary lighting loads where inductive loading such as transformers or ballasts are utilized.

In further detail terminals 27A and 278 are connected across the primary winding of current transformer TI, which particularly comprises a required turns ratio of the secondary windings of the current transformer. An alternating current through the primary coil of transformer TI generates a voltage across its secondary coil proportional to the current through its primary coil. The required turns ratio provides the required current sensitive transformer TI and allows the use of the auxiliary lighting circuit with considerably lower wattage gaseous discharge lamps to as low as 35-50 watts as well as mid-wattage gaseous discharge lamps of 50-450 watts. The required increased turns ratio is within the range of from 10% to 15% from the original number of turns.

In a particular embodiment wherein the auxiliary gaseous discharge lamp has a wattage as low as 35-50 watts, the required turns ratio of current transformer TI is at least 10% greater over the original number of turns, as is required to provide required alternating current per ampere of wattage required to cause a 35 watt gaseous discharge lamp to illuminate.

Triac Q1 is connected across terminals 102A and 1028. One terminal of triac Q2 is connected to terminal 102A and the other terminal of triac Q2 is connected to terminal 1028 through a phase shifting capacitor C3. One side of the TI secondary coil is connected to terminal 102A while the other side is connected to the gate input of triac Q2 through a current limiting resistor R5. The junction between triac Q2 and capacitor C3 is connected to the gate input of triac Q1 through diac D4.

A voltage across the TI secondary coil due to a current through the TI primary is thus applied to the gate of triac Q2 to render it conducting as determined by the timing circuit and reset circuit. With Q2 conducting, triac Q1 is maintained in the off state since insufficient voltage is applied through diac D4 to the gate input of Q1. Terminals 102A and 102B are thus effectively open circuited. On the other hand, when current through the TI primary ceases, no voltage appears across the TI secondary, which turns triac 0S off. Terminal 102B connected to the auxiliary power source is able to apply a sufficient voltage through capacitor C6 and diac D4 to the gate of Q1 to turn Q1 on and enable current to flow from terminal 102A to 102B. Auxiliary lamp 30 is thus operated in accordance with the operation of ballast 40.

In an application of the lighting control system to operate an auxiliary lighting lamp at 120 VAC and 50-60 Hz connected to a magnetic ballast with an input current of 120 VAC and 50-60 Hz for an HID lamp, it was found that the lighting control system was not activated by a "step" voltage to cause the auxiliary lamp to "turn on." The application demonstrated that magnetic ballast counterparts of electronic ballasts for an HID lamp exhibit a much different input characteristic than does an electronic ballast for an HID lamp. The electronic ballast draws low current when the HID lamp is not illuminated or at less than full illumination and then increases quickly in a "step" function to full current draw for cool-down, start-up and warm-up to full ramp ignition. Therefore, the instant lighting control system utilizes the sharp increase in threshold current in conjunction with the reset circuit and timing circuit, to initiate illumination of the auxiliary lighting lamp with an electronic ballast. In tests upon a variety of electronic ballasts, the instant invented lighting control system comprising the reset and timing circuits operated successfully to cause the lamp to "switch off" when the HID lamp reached full illumination.

However, in an application using a magnetic ballast, it was found that the instant lighting control system, which includes a timing circuit and a rest circuit, utilizes the input current of an HID lamp to initiate and control illumination of the auxiliary lamp. The instant invented lighting control system has been found to work properly with a magnetic ballast, despite the fact that the no-load and fully loaded input currents of a magnetic ballast are not significantly different to provide a step function, as provided by an electronic ballast. The current difference of a magnetic ballast does not provide a threshold current step function during operation sufficient to trigger the lamp control system to operate, but the timing circuit and rest circuit operate to control illumination of the auxiliary lamp.

In further explanation, electronic HID ballasts operating in the 150-450 watt area exhibit a step function comprising an input current characteristic much different from magnetic ballasts operating in the 150-450 watt area. The step function of an electronic ballast is defined as the sudden change in threshold current drawn by an electronic ballast for a high intensity density (HID) lamp upon full ignition versus current drawn by an electronic ballast for an HID lamp not illuminated or at less than full illumination. An electronic ballast for a high intensity discharge (HID) lamp draws almost no current when the HID lamp is not illuminated and then jumps to full current upon ignition of the lamp. The instant invented control system senses this step function in current drawn to operate the HID lamp and operates to turn off the auxiliary quartz lamp as determined by the reset and timing circuits when the HID lamp draws full current upon full illumination. The instant invented control system is accordingly controlled by the reset circuit and timing circuit to cause the 120 VAC 50-60 Hz auxiliary lamp to cease illumination upon full illumination by the HID lamp with either an electronic HID ballast or a magnetic HID ballast.

As noted above, FIGS. 1-6 represent typical applications and wiring diagrams for the invented auxiliary lamp lighting circuit and a 120 VAC electronic HID ballast and HID lamp and a 120 VAC magnetic HID ballast and HID lamp.

FIG. 5 represents a block diagram of the electrical schematic and components of the auxiliary lamp lighting controller that is comprised of six circuits:

(1) current sensing transformer circuit, comprised of T1, which converts current flowing through a high intensity discharge (HID) lamp into a useable voltage, and where:

(2) positive power supply circuit, comprised of D2, R3, Q5, R1 and C1, which converts positive AC sine wave voltages generated by the secondary windings of current sensing transformer T1 into a positive DC regulated power supply comprising a +4.5 volt DC regulated power supply across filter capacitor C1 and timing resistor R4, and where:

(3) negative power supply circuit, comprised of D5, R3, C4 and D7, which converts negative AC sine wave voltages generated by the secondary windings of current sensing transformer T1 into a negative regulated power supply comprising a −10 volt DC regulated power supply stored in and impressed upon reset capacitor C5 via reset resistor R2 with a bleeder resistor R3 necessary for the reset of timing circuit during the interruption of current flow through the primary windings of current sensing transformer T1, and where;

(4) reset circuit, comprised of D1, Q4, R2 and C5, which resets the timing circuit in the event that high intensity discharge (HID) lamp is extinguished as a result of power interruption or end-of-life cycling, and where, (5) timing circuit, comprised of C2, R4, Q3 and D6, which maintains the "on" state of auxiliary lighting source for a predetermined period of time, allowing high intensity discharge (HID) lamp to achieve full intensity before extinguishing auxiliary light source, and where:

(6) auxiliary lamp control circuit, comprised of Q1, Q2, C3, C6, R5 and D4, control the conductive state of Q1, which determines the status of auxiliary light source.

The theory of operation of this instant invention is as follows:

Auxiliary lamp controller circuit electronic switch with triac Q1 mains terminals MT1 and MT2 are connected in a series configuration between 120-volt AC mains source and auxiliary light source which in turn is connected to the common or neutral of mains supply (see FIG. 6). FIG. 6 illustrates that capacitor C3, C6 and resistor R5 are connected to triac Q1 gate via diac D4, which is a bidirectional 32-volt trigger or break-over device. Capacitor C3, C6 and resistor R5 form a voltage divider network where the AC voltage at diac D4 is approximately 50% of mains voltage and therefore sufficient to gate the triac Q1 "on", allowing mains current to flow to the auxiliary lighting source. Capacitor C6 and resistor R5 facilitate the "turn off" of triac Q1 by forming a voltage divider, and thereby reduce gate drive voltages available at diac D4 by approximately 50%. This voltage divider aids in "turn off" of triac Q1 wherein inductive loading such as transformers or ballasts are utilized in place of gaseous discharge tamps or incandescent light sources. The circuit described above represents a normal "on" state of the auxiliary tamp control.

The application and function of electronic switch triac Q2 is described below.

With current passing through the primary windings of current transformer T1 such as the illumination of a gaseous discharge lamp or other such device an AC voltage is generated in the secondary of current transformer T1 that is directly proportionate to the current flowing via primary of T1. The positive portion of the AC sine wave is directed through rectifier diode D2, forming a positive DC voltage between the emitter of Q5 and the cathode of diode D2. The DC voltage is initially impressed across filter capacitor C1 and cathode of Zener diode D3. As the potential of this DC voltage increases (based upon current flow through T1 primary), Zener diode D3 is forced into conduction via current limiting resistor R1. As the current flowing through resistor R1 increases, the base of NPN transistor Q5 is forward biased and Q5 begins to conduct, reducing DC voltage across filter capacitor C1. The circuit comprised of D3, R1 and Q5 form a shunt regulator that maintains a constant DC voltage across filter capacitor C1 irrespective of voltage potential being developed at the secondary of current sensing transformer T1.

The negative portion of the AC sine wave seen at the secondary of T1 is passed through rectifier diode D5 forming a negative DC voltage. Capacitor C4 serves as the filter capacitor, white Zener diode D7 serves to limit the peak DC voltage as determined by its Zener value. This negative DC voltage is also impressed upon reset capacitor C5 via resistor R2 to power supply common. Resistor R3 serves as a bleeder resistor during power interruptions, enabling the charge stored in capacitor C5 to reset the timing circuit as described below.

With current flowing through the primary of current sensing transformer T1, a positive DC voltage is seen across filter capacitor C1 as well as timing resistor R4. Timing resistor R4 serves as a current limiting devices and therefore controls the period of time necessary to charge capacitor C2. As the DC voltage available to timing resistor R4 is constant (regulated), so too is the period of time necessary to charge capacitor C2 to a potential sufficient to forward bias NPN transistor Q3. As the emitter of Q3 is connected to the power supply common, and Q3 is now in conduction, the collector of Q3 forces the gate of electronic switch triad Q2 to the same potential as Q3 emitter via blocking diode D6.

As described above, electronic switch triac Q1 is in a naturally conductive state as a result of a voltage impressed upon the gate of Q1 by voltage divider capacitor C3, C6 and resistor R5. Electronic switch triac Q2 is typically held in a non-conductive due to the "open collector" state of control transistor Q3, which in turn allows the gate of triac Q2 to "float". As MT2 of triac Q2 is electrically connected to the positive portion of the power supply, the forward conduction of Q3 putts the gate of triac Q2 low. This places triac Q2 in a conductive or "on" state, forcing the gate of triac Q1 to the potential of MT2, which renders triac Q1 non-conducting. As long as current flows through the primary of current sensing transformer T1, the positive DC voltage at the base of transistor Q3 will hold triac Q1 in an "off" state.

During power-down of the lighting fixture or the failure of a high intensity discharge (HID) lamp, the current flow through the primary of current sensing transformer T1 ceases, causing the collapse of the positive and negative power supply voltages. During this collapse of supply voltages, resistor R3 forms an electrical path for the energy stored in reset capacitor C5, and as capacitor C5 discharges, it impresses a positive DC voltage pulse on the base of reset transistor Q4, forcing transistor Q4 into a conductive state. This in turn discharges timing capacitor C2, and allows for a new timing cycle.

As a negative voltage is present during charging of capacitor C5 during power-up, diode D1 prevents any negative voltage during the charge cycle from exceeding −0.70 volts, thus preventing damage to transistor Q4.

In one particular embodiment of controller 20, particular components are as follows,

| QTY | COMP# | DESCRIPTION |
|---|---|---|
| 1 pc | R1 | 10K 1/4 w 5% resistor |
| 1 pc | R2 | 1.0M 1/4 w 5% resistor |
| 1 pc | R3 | 100K 1/4 w 5% resistor |
| 1 pc | R4 | 430K 1/4 w 5% resistor |
| 1 pc | R5 | 43K 1/4 w 5% resistor |
| 1 pc | C1 | 100 mfd 10 vdc electrolytic |
| 1 pc | C2 | 470 mfd 6.3 vdc electrolytic |
| 1 pc | C3 | .033 mfd 630 vdc Mylar |
| 1 pc | C4 | 22 mfd 63 vdc electrolytic |
| 1 pc | C5 | 4.7 mfd 35 vdc electrolytic |
| 1 pc | C6 | .047 mfd 50 vdc Mylar |
| 3 pc | D1, D2, D5 | 1N4148 75 v 150 ma diode |
| 1 pc | D3 | 1N5226B 3.3 v 500 mw Zener |
| 1 pc | D4 | 32 v Diac (Teccor HT32 or equiv) |
| 1 pc | D6 | 1N4006 800 v 1 a Diode |
| 1 pc | D7 | IN5240 10 v 500 mw Zener |
| 1 pc | Q1 | Q4006F41 400 v 6 a Triac |
| 1 pc | Q2 | L401E3 400 v 1 a Logic Triac |
| 2 pc | Q3, Q5 | MPS-A13 NPN Darlington or equiv |
| 1 pc | Q4 | 2N3904 NPN transistor |
| 1 pc | T1 | Current Transformer (turns ratio +10% to +15% increase from original number of turns) |

Although the invention has been described in conjunction with the foregoing specific embodiment, many alternatives, variations, and modifications wilt be apparent to those of ordinary skill in the art. These alternatives, variations, and modifications are intended to fail within the scope of the following appended claims.

In summary, the instant invention comprises a high intensity discharge (HID) lamp ballast system having an HID electronic ballast or a HID magnetic ballast operating in conjunction with an alternating current power input, an auxiliary lamp and auxiliary lamp controller with a reset circuit and timing circuit for start-up and turn-off modes of operation of said auxiliary lamp by solid-state switches comprising gated triacs of said auxiliary lamp controller in response to presence of no input current and full magnitude of input current to said ballast. The said auxiliary lamp lighting controller comprises a current sensing transformer circuit, a positive power supply circuit, a negative power supply circuit, a reset circuit, a timing circuit, and an auxiliary lamp control circuit.

In an embodiment with an electronic HID ballast, the controller with reset and timing circuits comprises, in combination, (a) a current transformer comprising primary and secondary coils with the transformer connected in the HID lamp common input tap of said electronic HID ballast and to said AC power input, so as to produce a voltage in the secondary coil in proportion to the current drawn by the said electronic HID ballast: (b) a first gated triac connected in series between said auxiliary lamp and said power input and said secondary coil providing voltage according to a current drawn by said electronic HID ballast through said primary coil; (c) a second gated triac coupled between said first gated triac and said current transformer such that said first gated triac is rendered to a non-conductive state only when current is drawn by the said high intensity discharge (HID) lamp and rendered to a conductive state only when no current is drawn by said high intensity discharge (HID) lamp so as to supply power from said power input to said auxiliary lamp only when no current is drawn by said high intensity discharge (HID) lamp; and (d) an auxiliary lamp ballast connected in series to the auxiliary lamp when said auxiliary lamp requires a ballast, wherein the second gated triac is coupled to said first gated triac, the gating of said first triac being received through a diac coupled to the second gated triac. The secondary coil of said current transformer is connected as a gating input to the second gated triac, and a phase-shifting capacitor is coupled between the output after said first triac and the output of said second triac to maintain said first triac in the conductive state until the second triac conducts. The reset and timing circuits control the illumination of the auxiliary lamp during the extinguished, cool-down, start-up and warm-up phases of operation of the HID lamp.

Accordingly, the instant invention comprises an auxiliary lamp control system comprising an auxiliary lamp controller activated by current level of an HID electronic or current of an HID magnetic ballast and alternating current power input to control operation of an auxiliary lamp of start-up and turn-off modes of operation of said lamp by solid-state switches comprising gated triacs of said auxiliary lamp controller in response to the magnitude of input current to said electronic or magnetic HID ballast wherein said auxiliary lamp lighting controller utilizes the reset circuit and timing circuit of the controller circuit and a solid-state switch for lighting an auxiliary lamp for a high intensity discharge (HID) lamp.

In an application with an electronic HID ballast and an auxiliary lamp comprising an auxiliary gaseous discharge lamp, wherein the power source is 120 VAC at 50-60 Hz and the 120 VAC electronic ballast comprises frequencies of from 100 Hz to over 400 kHz and provides a step function, the said auxiliary lamp controller comprises, in combination, (a) a current transformer having primary and secondary coils with the transformer connected to the power common input tap of said electronic ballast and to said AC power input of said electronic ballast, so as to produce a voltage in the secondary coil in proportion to the current drawn by said electronic HID ballast; (by a first solid-state switch having an input and an output and coupled to said secondary coil of said transformer such that a voltage at the secondary coil causes the first switch to electrically close between its input and output, and such that no voltage at the secondary coil causes the first switch to electrically open between its input and output; (c) a second solid-state switch coupled to the first solid-state switch, and having an input and output, such that when the first solid-state switch is closed between its input and output, the second solid-state switch is substantially always open between its input and output, and when the first solid-state switch is open between its input and output, the second solid-state switch is substantially always closed between its input and output; and (d) an auxiliary gaseous discharge lamp ballast connected in series to said auxiliary gaseous discharge lamp, wherein the first solid-state switch is a triac having a gate element. The second solid-state switch is a second triac having a gate element, being coupled to the first triac with the gate element of the second triac being connected through a diac to the first triac output. The secondary coil of said current transformer is connected to the gate element of the first triac. The secondary coil of said current transformer is connected to the gate element of the first triac through a current limiting resistor, and a phase-shifting capacitor is coupled between the output of the first tiac and the output of the second triac.

In an alternative embodiment with a magnetic HID ballast and an auxiliary lamp comprising an auxiliary gaseous discharge lamp, wherein the power source is 120 VAC at 50-60 Hz, the controller circuit functions in the absence of a "step" function as is supplied by an electronic ballast. However, the controller circuit functions with a magnetic ballast to control the auxiliary gaseous discharge lamp to provide auxiliary illumination in accordance with the reset circuit and timing circuit included in the controller circuit, as required by the above embodiment with an electronic ballast, in response to the extinguished, cool-down, start-up and warm-up phases of the HID lamp.

In summary, the instant invention comprises a high intensity discharge (HID) lamp system comprising an HID electronic ballast or an HID magnetic ballast, an HID lamp, an alternating current power input, an auxiliary lamp providing illumination during extinguished, cool-down, start-up and warm-up phases of said HID lamp including an auxiliary lamp controller for start-up and turn-off modes of operation of said auxiliary lamp by solid-state switches comprising gated triacs of said auxiliary lamp controller in response to presence of no input current and full magnitude of input current to said ballast wherein said auxiliary lamp lighting controller comprises, in combination: (a) a current sensing transformer circuit that converts current to said ballast to a required voltage, (b) a positive voltage power supply circuit that converts positive AC sine wave voltages generated by said current sensing transformer into a positive DC regulated power supply across a filter capacitor and a timing resistor, (c) a negative voltage power supply circuit that converts negative AC sine wave voltages generated by secondary windings of said current sensing transformer into a negative regulated power supply stored in a capacitor with a bleeder resistor for reset of timing circuit during interruption of current flow through primary windings of said current sensing transformer; (d) a reset circuit that resets a timing circuit upon extinguishing of illumination of said high intensity discharge (HID) lamp from power interruption and end-of-life cycling; (e) a timing circuit that maintains said auxiliary lamp in illumination for a predetermined period of time to permit time during phases of said high intensity discharge (HID) lamp of extinguished illumination, cool-down, start-up and warm-up to obtain full illumination by said HID lamp and the auxiliary lamp thereupon ceases illumination; and (f an auxiliary lamp control circuit that comprises a solid-state switch comprising two gated transistors in conjunction with a diac transistor and a coupled transformer wherein the auxiliary lamp is selected from the group consisting of quartz lamps, incandescent lamps, quartz vapor lamps, gaseous discharge lamps, fluorescent lamps and light emitting diode (LED) lamps.

In further summary, the high intensity discharge (HID) lamp control system comprises a current sensitive transformer circuit of said auxiliary lamp lighting controller wherein the ratio of secondary winding to the primary winding of transformer of said current sensitive transformer circuit comprises a required turns ratio of said current sensitive transformer that provides required alternating current to said auxiliary lamp lighting controller with low wattage auxiliary quartz lamps of 35-50 watts wherein said required increase in turns ratio is within the range of from 10% to 15% over the original number of turns, or wherein said required turns ratio of said secondary winding to said primary winding of said current sensing transformer is at least 10% greater over the original number of turns.

In further summary, the auxiliary lamp lighting control system comprises an auxiliary lamp controller which comprises, in combination: (a) a current transformer circuit comprising primary and secondary coils with the transformer connected to the power common input tap of said HID ballast and to said AC power input of said HID ballast, so as to produce a voltage in the secondary coil in proportion to the current drawn by the said HID ballast; (b) a first gated triac connected in series between said auxiliary lamp and said power input and said secondary coil providing voltage according to a current drawn by said HID ballast through said primary coil; (c) a second gated triac coupled between said first gated triac and said current transformer such that said first gated triac is rendered to a non-conductive state only when current is drawn by the said high intensity discharge (HID) lamp and rendered to a conductive state only when no current is drawn by said high intensity discharge (HID) lamp so as to supply power from said power input to said auxiliary lamp only when no current is drawn by said high intensity discharge (HID) lamp; and (d) an auxiliary gaseous discharge lamp ballast connected in series to the auxiliary gaseous discharge lamp when said auxiliary lamp is a gaseous discharge lamp, wherein the second gated triac is coupled to said first gated triac, the gating of said first triac being received through a diac coupled to the second gated triac, wherein the secondary coil of said current transformer is connected as a gating input to the second gated triac, a phase-shifting capacitor coupled between the output after said first triac and the output of said second triac to maintain said first triac in the conductive state until the second triac conducts.

In further summary, the instant invention comprises in an alternative embodiment, in combination, a high intensity discharge lamp system having an HID electronic ballast and alternating current power input, an auxiliary gaseous discharge lamp and ballast and auxiliary gaseous discharge lamp controller for start-up and turn-off modes of operation of said gaseous discharge lamp by solid-state switches comprising gated triacs of said auxiliary gaseous discharge lamp controller in response to the magnitude of input current to said electronic HID ballast, wherein said auxiliary gaseous discharge lamp lighting controller utilizes a current step function and a solid-state switch for said auxiliary lighting gaseous discharge lamp to a high intensity discharge (HID) lamp and said electronic HID ballast, wherein the power source is 120 VAC at 50-60 Hz and the electronic ballast power source comprises 120 VAC at frequencies of 50-60 Hz, wherein said auxiliary gaseous discharge lamp controller comprises, in combination: (a) a current sensing transformer having primary and secondary coils with the transformer connected to the power common input tap of said electronic ballast and to said AC power input of said electronic ballast, so as to produce a voltage in the secondary coil in proportion to the current drawn by said electronic HID ballast; (b) a first solid-state switch having an input and an output and coupled to said secondary coil of said transformer such that a voltage at the secondary coil causes the first switch to electrically close between its input and output, and such that no voltage at the secondary coil causes the first switch to electrically open between its input and output, and a second solid-state switch coupled to the first solid-state switch, and having an input and output, such that when the first solid-state switch is closed between its input and output, the second solid-state switch is substantially always open between its input and output, and when the first solid-state switch is open between its input and output, the second solid-state switch is substantially always closed between its input and output; and (c) an auxiliary gaseous discharge lamp ballast connected in series to the auxiliary gaseous discharge lamp, wherein the first solid-state switch is a triac having a gate element, wherein the second solid-state switch is a second triac having a gate element and being coupled to the first triac with the gate element of the second triac being connected through a diac to the first triac output, wherein the secondary coil of said current transformer is connected to the gate element of the first triac through a current limiting resistor, and a phase-shifting capacitor coupled between the output of the first triac and the output of the second triac.

In further summary, the instant invention comprises in an alternative embodiment, in combination, a high intensity discharge (HID) lamp control system having an HID magnetic ballast and alternating current power input, an auxiliary lamp and auxiliary lamp controller for start-up and turn-off modes of operation of said auxiliary lamp by solid-state switches comprising gated triacs of said auxiliary ramp controller in response to input current to said magnetic HID ballast, wherein said auxiliary lamp Sighting system utilizes a solid-state switch for an auxiliary lamp to a high intensity discharge (HID) lamp on said magnetic HID ballast, wherein the power source is 120 VAC at 50-60 Hz and the magnetic ballast power source comprises 120 VAC at frequencies of 50-60 Hz, wherein said auxiliary lamp controller comprises, in combination: (a) a current sensing transformer having primary and secondary coils with the transformer connected to the power common input tap of said magnetic ballast and to said AC power input of said magnetic ballast, so as to produce a voltage in the secondary coil; (b) a first solid-state switch having an input and an output and coupled to said secondary coil of said transformer such that a voltage at the secondary coil causes the first switch to electrically close between its input and output, and such that no voltage at the secondary coil causes the first switch to electrically open between its input and output, and a second solid-state switch coupled to the first solid-state switch, and having an input and output, such that when the first solid-state switch is closed between its input and output, the second solid-state switch is substantially always open between its input and output, and when the first solid-state switch is open between its input and output, the second solid-state switch is substantially always closed between its input and output; and (c) an auxiliary lamp connected in series to the AC power input, wherein the first solid-state switch is a triac having a gate element, the second solid-state switch is a second triac having a gate element and being coupled to the first triac with the gate element of the second triac being connected through a diac to the first triac output, the secondary coil of said current transformer is connected to the gate element of the first triac through a current limiting resistor, and a phase-shifting capacitor coupled between the output of the first triac and the output of the second triac.

What is claimed is:

1. A high intensity discharge (HID) lamp system comprising an HID ballast, an HID lamp, an alternating current power input, an auxiliary lamp providing illumination during extinguished, cool-down, start-up, and warm-up phases of the HID lamp including an auxiliary lamp controller for staff-up and turn-off modes of operation of the auxiliary lamp by solid-state switches comprising gated triacs of the auxiliary lamp controller in response to the presence of no input current and the presence of input current to the HID ballast wherein the auxiliary lamp controller comprises, in combination:

(a) a current sensing transformer circuit that converts current to the HID ballast to a required voltage;

(b) a positive voltage power supply circuit that converts positive AC sine wave voltages generated by the current sensing transformer into a positive DC regulated power supply across a filter capacitor and a timing resistor;

(c) a negative voltage power supply circuit that converts negative AC sine wave voltages generated by secondary windings of the current sensing transformer into a negative regulated power supply stored in a capacitor with a bleeder resistor for reset of a timing circuit during interruption of the current through primary windings of the current sensing transformer;

(d) a reset circuit that resets the timing circuit upon extinguishing of illumination of the high intensity discharge (HID) lamp from power interruption and end-of life cycling, wherein the timing circuit maintains the auxiliary lamp in illumination for a predetermined period of time to permit time during phases of the high intensity discharge (HID) lamp of extinguished, illumination, cool-down, start-up, and warm-up to obtain full illumination by the HID lamp, wherein the auxiliary lamp thereupon ceases illumination; and (e) an auxiliary lamp control circuit that comprises a solid-state switch comprising two gated transistors in conjunction with a diac transistor and a coupled transformer.

2. The high intensity discharge (HID) lamp system as set forth in claim 1 wherein said HID ballast is an electronic ballast.

3. The high intensity discharge (HID) lamp system as set forth in claim 1 wherein said HID ballast is a magnetic ballast.

4. The high intensity discharge (HID) lamp system as set forth in claim 1 wherein the auxiliary lamp is selected from a group consisting of quartz lamps, incandescent lamps, quartz vapor lamps, gaseous discharge lamps, fluorescent lamps and light emitting diode (LED) lamps wherein quartz vapor lamps, gaseous discharge lamps, and fluorescent lamps have associated control ballasts.

5. The high intensity discharge (HID) lamp system as set forth in claim 1 wherein a ratio of the secondary winding to the primary winding of the current transformer of the current sensing transformer circuit comprises a required turns ratio of the current sensing transformer that provides required alternating current to the auxiliary lamp lighting controller and to low-wattage auxiliary lamps of 35-50 watts.

6. The high intensity discharge (HID) lamp system as set forth in claim 5 wherein the required turns ratio of the secondary winding to the primary winding of the current sensing transformer circuit wherein the required turns ratio is within the range of from 10% to 15% over an original number of turns.

7. The high intensity discharge (HID) lamp system as set forth in claim 6 wherein the required turns ratio of the secondary winding to the primary winding of the current sensing transformer is at least 10% greater over the original number of turns.

8. The high intensity discharge (HID) lamp system as set forth in claim 1, wherein, of the auxiliary lamp lighting controller, (a) the primary and secondary windings of the current transformer circuit are connected to a power common input tap of the HID ballast and to an AC power input of the HID ballast, so as to produce a voltage in the secondary coil in proportion to the current drawn by the HID ballast;

(b) the gated triacs comprising a first gated triac connected in series between the auxiliary lamp and the power input and the secondary windings providing voltage according to the current drawn by the HID ballast through the primary windings, a second gated triac coupled between the first gated triac and the current sensing transformer such that the first gated triac is rendered to a non-conductive state only when the current is drawn by the high intensity discharge (HID) lamp and rendered to a conductive state only when no current is drawn by the high intensity discharge (HID) lamp so as to supply power from the power input to the auxiliary lamp only when no current is drawn by the high intensity discharge (HID) lamp; and (c) an auxiliary lamp ballast connected in series to the auxiliary lamp.

9. The high intensity discharge (HID) lamp system as set forth in claim 8, wherein the second gated triac is coupled to the first gated triac, the gating of the first triac being received through a diac coupled to the second gated triac.

10. The high intensity discharge (HID) lamp system as set forth in claim 8, wherein the secondary windings of the current transformer is connected as a gating input to the second gated triac.

11. The high intensity discharge (HID) lamp system as set forth in claim 8, further comprising a phase-shifting capacitor coupled between an output after the first triac and an output of the second triac to maintain the first triac in a conductive state until the second triac conducts.

12. A high intensity discharge lamp system comprising an HID electronic ballast and an alternating current power input, an auxiliary lamp, and an auxiliary lamp lighting controller for staff-up and turn-off modes of operation of the auxiliary lamp by solid-state switches comprising gated triacs of the auxiliary lamp controller in response to the magnitude of input current to the HID electronic ballast, wherein the auxiliary lamp lighting controller utilizes a current step function of the HID electronic ballast and a solid-state switch for lighting the auxiliary lamp to a high intensity discharge (HID) lamp and the HID electronic ballast, wherein a power source is 120 VAC at 50-60 Hz and an electronic ballast power source comprises 120 VAC at frequencies of 50-60 Hz, wherein the auxiliary lamp controller comprises, in combination:

(a) a current sensing transformer having primary and secondary windings with the current sensing transformer connected to a power common input tap of said HID electronic ballast and to an AC power input of the HID electronic ballast, so as to produce a voltage in the secondary winding in proportion to a current drawn by the HID electronic ballast;

(b) a first solid-state switch having an input and an output and coupled to the secondary winding of current sensing transformer such that a voltage at the secondary winding causes the first solid-state switch to electrically close between the input and the output of the first solid-state switch, and such that no voltage at the secondary winding causes the first solid-state switch to electrically open between the input and the output of the first solid-state switch, and a second solid-state switch coupled to the first solid-state switch, the second solid-state switch having an input and output, such that when the first solid-state switch is closed between the input and the output of the first solid-state switch, the second solid-state switch is substantially always open between the input and the output of the second solid-state switch, and when the first solid-state switch is open between the input and the output of the first solid-state switch, the second solid-state switch is substantially always closed between the input and the output of the second solid-state switch; and (c) an auxiliary gaseous discharge lamp ballast connected in series to the auxiliary lamp wherein the auxiliary lamp is a gaseous discharge lamp.

13. The high intensity discharge lamp system as set forth in claim 12, wherein the first solid-state switch is a triac having a gate element.

14. The high intensity discharge lamp system as set forth in claim 12, wherein the second solid-state switch is a second triac having a gate element and being coupled to the first triac with the gate element of the second triac being connected through a diac to the first triac output.

15. The high intensity discharge lamp system as set forth in claim 12, wherein the secondary coil of the current sensing transformer is connected to the gate element of the first triac.

16. The high intensity discharge lamp system as set forth in claim 12, wherein the secondary coil of the current sensing transformer is connected to the gate element of the first triac through a current limiting resistor.

17. The high intensity discharge lamp system as set forth in claim 12, further comprising a phase-shifting capacitor coupled between the output of the first triac and the output of the second triac.

18. A high intensity discharge (HID) lamp system having an HID magnetic ballast and an alternating current power input, an auxiliary lamp, and an auxiliary lamp controller for staff-up and turn-off modes of operation of the auxiliary lamp by solid-state switches comprising gated triacs of the auxiliary lamp controller in response to input current to the HID magnetic ballast, wherein the auxiliary lamp lighting controller utilizes a solid-state switch for the auxiliary lamp to the high intensity discharge (HID) lamp on the HID magnetic ballast, wherein the power source is 120 VAC at 50-60 Hz and the HID magnetic ballast power source comprises 120 VAC at frequencies of 50-60 Hz, wherein the auxiliary lamp controller comprises, in combination:

(a) a current sensing transformer having primary and secondary windings, with the current sensing transformer connected to a power common input tap of the HID magnetic ballast and to an AC power input of the HID magnetic ballast, so as to produce a voltage in the secondary windings; and (b) a first solid-state switch having an input and an output and coupled to the secondary coil of the current sensing transformer such that a voltage at the secondary windings causes the first solid-state switch to electrically close between its input and output, and such that no voltage at the secondary windings causes the first solid-state switch to electrically open between the input and the output of the first solid-state switch, and a second solid-state switch coupled to the first solid-state switch, the second solid-state switch having an input and output, such that when the first solid-state switch is closed between the input and the output of the first solid-state switch, the second solid-state switch is substantially always open between the input and the output of the second solid-state switch, and when the first solid-state switch is open between the input and the output of the first solid-state switch, the second solid-state switch is substantially always closed between input and the output of the second solid-state switch, wherein the auxiliary lamp is connected in series to the AC power input and to the auxiliary lamp controller.

19. The high intensity discharge (HID) lamp system as set forth in claim 18, wherein the first solid-state switch is a triac having a gate element.

20. The high intensity discharge (HID) lamp system as set forth in claim 18, wherein the second solid-state switch is a second triac having a gate element and being coupled to the first triac with the gate element of the second triac being connected through a diac to the first triac output.

21. The high intensity discharge (HID) lamp system as set forth in claim 18, wherein the secondary windings of the current sensing transformer is connected to the gate element of the first triac.

22. The high intensity discharge (HID) lamp system as set forth in claim 18, wherein the secondary windings of the current sensing transformer is connected to the gate element of the first triac through a current limiting resistor.

23. The high intensity discharge (HID) lamp system as set forth in claim 18, further comprising a phase-shifting capacitor coupled between the output of the first triac and the output of the second triac.

24. The high intensity discharge (HID) lamp system as set forth in claim 18, wherein the auxiliary lamp is selected from a group consisting of quartz lamps, incandescent lamps, quartz vapor lamps, gaseous discharge lamps, fluorescent lamps, and light emitting diode (LED) lamps wherein the quartz vapor lamps, gaseous discharge lamps, and fluorescent lamps have associated control ballasts.

* * * * *

UNITED STATES PATENT AND TRADEMARK OFFICE

CERTIFICATE OF CORRECTION

PATENT NO. : 7,397,194 B2
APPLICATION NO. : 11/469484
DATED : July 8, 2008
INVENTOR(S) : Garbowicz et al.

It is certified that error appears in the above-identified patent and that said Letters Patent is hereby corrected as shown below:

Column 17: Claim 1, line 5 should read, --lamp including an auxiliary lamp controller for start-up and--

Column 18: Claim 5, line 3 should read, --the primary winding of the current sensing transformer of the current--

Column 18: Claim 12, line 4 should read, --for start-up and turn-off modes of operation of the auxiliary--

Column 19: Claim 18, line 4 should read, --start-up and turn-off modes of operation of the auxiliary lamp--

Signed and Sealed this

Twenty-sixth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,397,194 B2
APPLICATION NO. : 11/469484
DATED : July 8, 2008
INVENTOR(S) : Garbowicz et al.

It is certified that error appears in the above-identified patent and that said Letters Patent is hereby corrected as shown below:

Column 17: Claim 1, line 21 should read, --lamp including an auxiliary lamp controller for start-up and--

Column 18: Claim 5, line 1 should read, --the primary winding of the current sensing transformer of the current--

Column 18: Claim 12, line 59 should read, --for start-up and turn-off modes of operation of the auxiliary--

Column 19: Claim 18, line 55 should read, --start-up and turn-off modes of operation of the auxiliary lamp--

This certificate supersedes the Certificate of Correction issued August 26, 2008.

Signed and Sealed this

Sixteenth Day of September, 2008

JON W. DUDAS
*Director of the United States Patent and Trademark Office*